US005299930A

United States Patent [19]

Weidman

[11] Patent Number: 5,299,930

[45] Date of Patent: Apr. 5, 1994

[54] LOW NOX BURNER

[75] Inventor: George Weidman, Carrolton, Tex.

[73] Assignee: Forney International, Inc., Addison, Tex.

[21] Appl. No.: 973,701

[22] Filed: Nov. 9, 1992

[51] Int. Cl.[5] ..... F23M 3/04

[52] U.S. Cl. ..... 431/10; 431/187; 431/174; 431/284; 431/351

[58] Field of Search ..... 431/284, 285, 174, 187, 431/188, 351, 10

[56] References Cited

U.S. PATENT DOCUMENTS

| | | | |
|---|---|---|---|
| 2,851,093 | 9/1958 | Zink et al. | 431/285 |
| 3,115,851 | 12/1963 | Ceely | 110/22 |
| 4,023,921 | 5/1977 | Anson | 431/9 |
| 4,257,763 | 3/1981 | Reed | 431/188 |
| 4,297,093 | 10/1981 | Morimoto et al. | 431/10 |
| 4,347,052 | 8/1982 | Reed et al. | 431/284 |
| 4,443,182 | 4/1984 | Wojcieson et al. | 431/183 |
| 4,629,413 | 12/1986 | Michelson et al. | 431/9 |
| 4,930,430 | 6/1990 | Allen et al. | 431/285 |

OTHER PUBLICATIONS

European Patent application, 0452608, Oct. 1991.

"Coen Low NOx Design Techniques Readily Solve Your Emission Problems", Coen Company, Inc., Technical Bulletin 20-102, Published prior to Jul. 28, 1992.

*Primary Examiner*—Carroll B. Dority

*Attorney, Agent, or Firm*—Lane, Aitken & McCann

[57] ABSTRACT

In a low NOx burner, oil and gas are distributed into the combustion zone from within a central tube, surrounded by an outer tube to define an annular channel between the central tube and the outer tube. A windbox surrounds the inner and outer tubes to introduce air into the annular channel and through openings in the inner tube into the central tube. The central tube and outer tube are sized so that the velocity of air through the outer tube is substantially greater than the velocity of air flow through the inner tube to the combustion zone so that an axial recirculating air flow is generated in the combustion zone. The difference in the velocity of the air streams is maintained small enough so that minimum turbulence is generated in the combustion. The air flow paths are constructed so that no angular rotation in the air flow occurs in the combustion zone.

12 Claims, 3 Drawing Sheets

LOW NOX BURNER

BACKGROUND OF THE INVENTION

This invention relates to a combined oil and gas burner designed to achieve low levels of nitrogen oxides, commonly known as NOx, in the combustion products of the burner.

NOx emissions from burners used in power plants and other industrial applications are a substantial source of air pollution and the design of burners which will produce low NOx emissions has been the subject of substantial research and development. Many techniques employed to reduce NOx emissions are designed to reduce the temperature in the combustion zone of the burner, because reduced temperature is conducive to burning with low NOx emissions. Lower combustion temperatures and, therefore, lower NOx emissions are achieved in prior systems, by introducing combustion products into the combustion zone, such as by recirculating flue gas into the combustion zone or by providing multi-stage burning wherein preburning is caused to take place upstream of the main burner flame. Other techniques involve using primary air with limited oxygen supply to establish a primary burning zone and introducing secondary air for a secondary flame zone downstream from the primary flame.

SUMMARY OF THE INVENTION

The present invention provides a burner with very low NOx emissions by a technique different from the techniques employed in the prior art. In accordance with the present invention, the burner is mounted on the furnace wall supplied with air from a windbox. The burner comprises a central oil nozzle surrounded by a plurality of angularly spaced gas canes. Relatively low velocity air from the windbox is provided to a central tube surrounding the oil nozzle and gas canes and higher velocity air from the windbox is provided from the windbox to an annular channel defined between the central tube and an outer tube. The two air streams are introduced without twirling into the combustion zone immediately downstream of the nozzle and gas canes and cause an axially recirculating flow pattern in the combustion zone. The relative velocities of the two streams are sufficiently different to create the axial recirculation, but not so different as to create substantial turbulence which would raise the temperature in the combustion zone. It is important with respect to achieving low NOx emissions that no angular flow component be provided to the gases flowing into the combustion zone, as angular flow causes an increase in temperature in the combustion zone and will accordingly increase the NOx emissions.

DESCRIPTION OF THE PREFERRED EMBODIMENT

Figure 1:
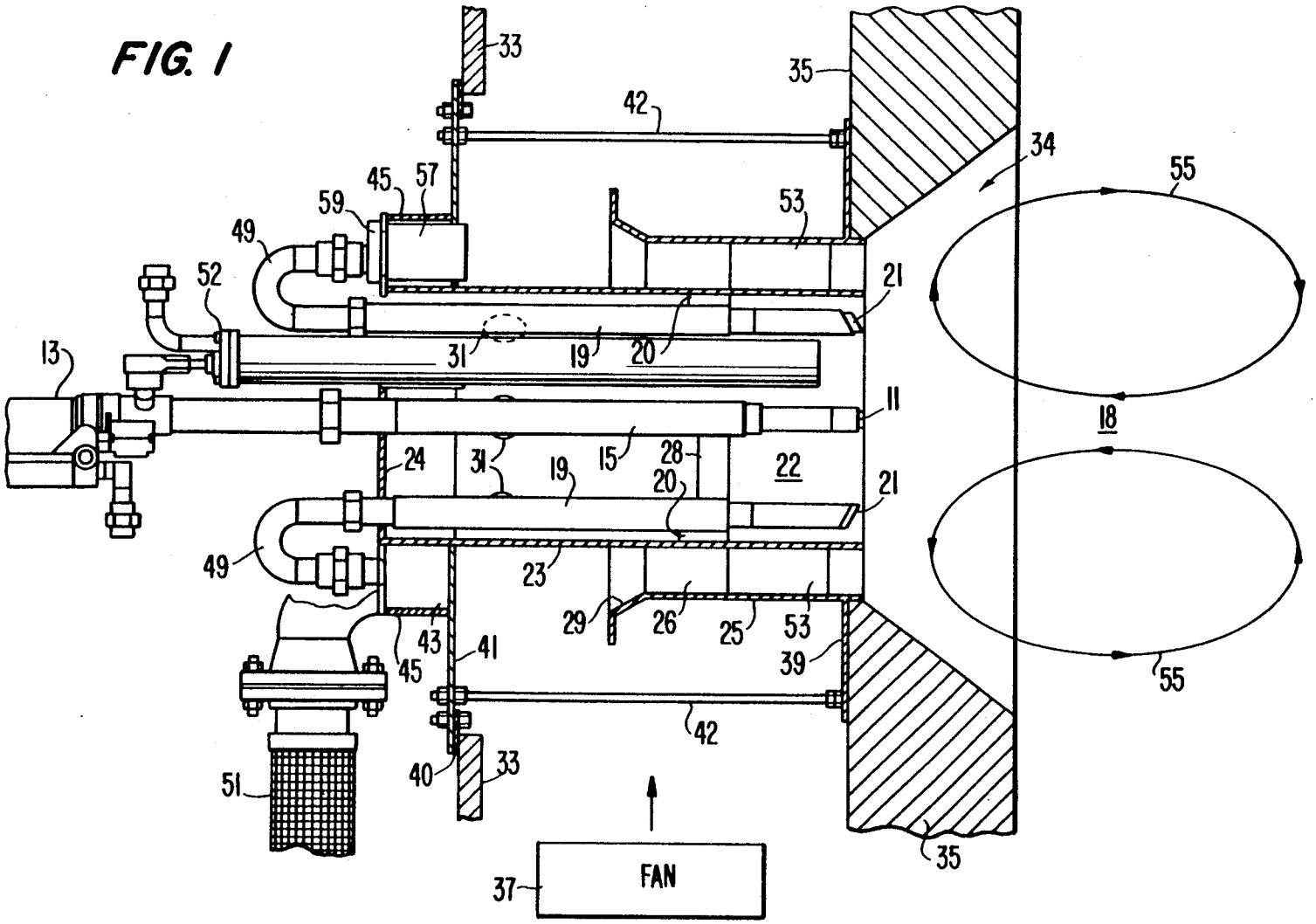
FIG. 1 is an axial sectional view of the burner of the present invention.
Figure 2:
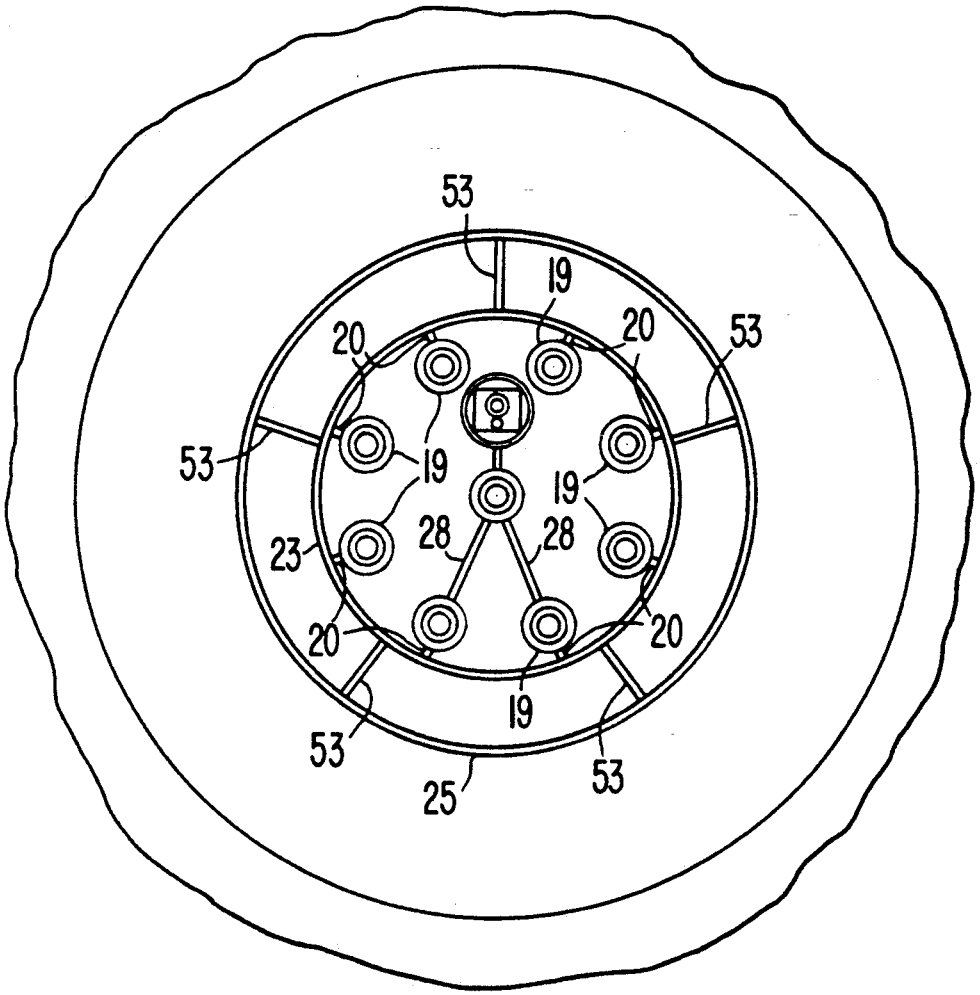
FIG. 2 is a view of the distal end of the burner.
Figure 3:
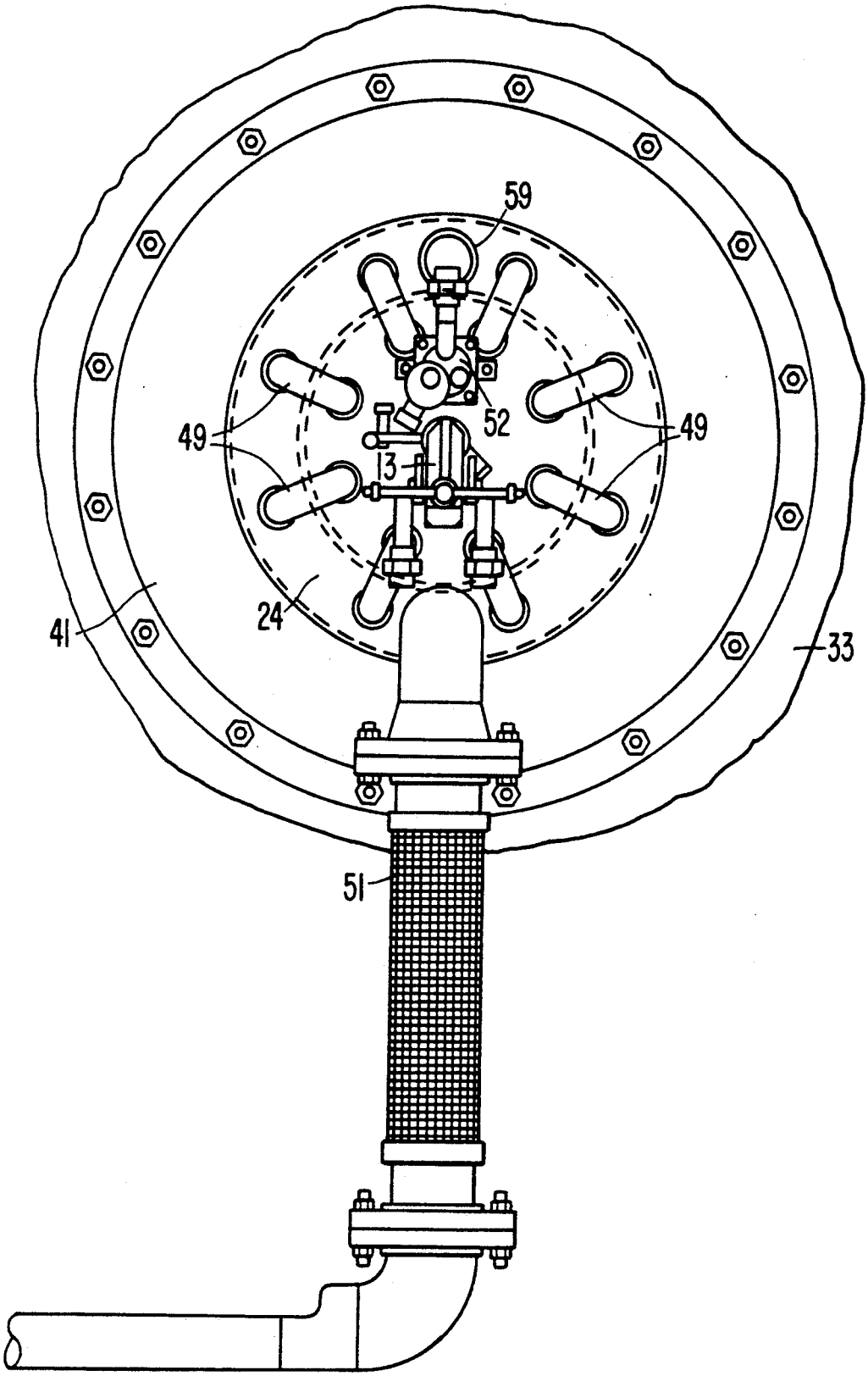
FIG. 3 is an end view of the proximal end of the burner.

As shown in the drawings, the burner comprises an oil nozzle 11 located on the axis of the burner and fed with oil under pressure from an oil gun 13 through a pipe 15. The nozzle is shaped to spray the oil at an angle of 30–45 degrees to the axis into the combustion zone 18 of the burner. The oil pipe 15 is surrounded by eight gas canes 19, which are terminated in aperture plates 21, preferably angled with respect to the cross-sectional plane of the burner at an angle of between 15 and 30 degrees so that the gas is discharged at an angle of between 15 and 30 degrees to the burner axis into the combustion zone 18. In the specific described embodiment, this angle is in the range of 20 to 25 degrees. The oil pipe 15 and the canes 19 are surrounded by an inner tube 23 closed at its proximal end by plate 24 and open at its distal end to the combustion zone 18 of the burner. The tube 23 defines therewithin an inner air zone 22 in which gas canes 19 are located. The gas canes are supported from the inner wall of the central tube 23 by plates 20. The oil pipe 15 is supported in the axis of the burner by plates 28 extending from two of the gas canes 19. The plates 20 and 28 are positioned in axial planes so as to promote axial flow in the inner zone 22. The distal end of the tube 23 is surrounded by an outer tube 25 extending to the combustion zone and open at both ends. An outer air zone is defined in the annular channel 26 between tubes 25 and 23. The tube 25 is provided with a flared or funneled opening 29 at its proximal end to promote smooth air flow in the outer zone to the combustion zone. A series of openings 31 are defined through the wall of the tube 23 distributed circumferentially around the tube 23 located towards the proximal end of the tube 23.

Air under low pressure is provided to the burner by mounting the burner in a windbox defined between a back wall 33 and the furnace wall 35. Axial flow is provided in the annular channel 26 by the windbox providing uniform air pressure distribution around the flared proximal end 29 of the outer tube 25. Axial flow is further promoted by vanes 53 which extend in radial planes between the inner tube and the outer tube. The vanes 53 support the front end of the central tube 23 coaxially in the outer tube 25. Air under pressure is provided to the windbox by means of a fan 37 shown schematically in FIG. 1. The fan provides a gauge pressure of less one psi in the windbox. At full load, the gauge pressure in the windbox ranges between 4 and 10 inches of water in the preferred embodiment. The air will flow into the flared end 29 and through the annular channel 26 and also will be metered through the openings 31 into the inner air zone 22 within the tube 23. The vanes 53 divide the annular channel 26 into arcuate segments and the velocity of air flow through each segment will be equal. The apertures 31 meter the air flow into the inner zone 22 so that only 10–20 percent of the air flows to the combustion zone 18 through the tube 23 and the remainder of the air flows through the annular channel 26 between the tube 25 and the tube 23.

The burner structure is positioned in a burner port 34 defined in the furnace wall 35. The port 34 is flared outwardly so that it has a smaller diameter on its inner side than on its outer side. The distal end of the outer tube 25 fits within the inner side of the port 34.

The back of the burner structure extends through a circular opening in the back wall 33 of the windbox, which opening is aligned with the burner port 39 in the furnace wall 35. The burner structure includes a circular front plate 39 which is welded to the back face of the furnace wall 35. The plate 39 is provided with a circular opening which is aligned with the port in the furnace wall 35. The outer tube 25 in the specific embodiment shown in the drawings is welded to the front plate 39 at its circular opening and extends through this circular opening. Alternatively, the connection between the plate 39 and the outer tube 25 may be a slip joint, and preferably is a slip joint in larger burners to allow for thermal expansion. The burner also has a back plate 41, which is provided with a central circular opening through which the tube 23 extends. The tube 23 is welded to the back plate 41 at the opening in the back plate 41. The back plate 41, which is circular, overlaps the periphery of the opening in the back wall of the back wall 23 and abuts the back surface of the back wall 33 sandwiching a gasket 40 therebetween. The gasket 40 is fixed to the periphery of the back plate 41 by screws distributed around the periphery of the back plate 41. The back plate 41, the tube 23, and the plate 24 close the opening in the back wall 33 to air flow. Four stay bolts 42 are distributed around the tubes 23 and 25 extending between the plates 39 and 41 and are fixed to the plates 39 and 41 to stabilize the burner structure. A toroidal gas manifold 43 is defined by the back plate 41, the back end of the tube 23 and a cylindrical wall 45 welded to the back plate 41. The back side of the manifold 43 is closed by the plate 24, which extends to the cylindrical wall 45. The gas canes 19 have U-shaped connectors 49 connecting the gas canes 19 to the manifold 43 through the plate 24. Gas under pressure of 5 to 30 psi is applied to the manifold 43 through a conduit 51 and gas from the conduit flows from the manifold through the gas canes to be directed outwardly through the apertured end plates 21 of the gas canes.

A pilot gas igniter 52 extends through the plate 24 and will generate a gas ignition flame from its distal end spaced a little behind the oil nozzle 11 and the distal ends of the gas canes 19. The igniter pilot flame is ignited by electrical ignition.

A viewing port 57 closed by a lens 59 is provided extending through the manifold 43 and through the back plate 41 to enable the burner flame to be visually inspected.

In operation, air under pressure is provided by the fan 37 to the windbox defined between the furnace wall 35 and the back wall 33. The windbox applies a reservoir of air under low pressure to the flared back end 29 of the tube so that the air flows smoothly into the back end of this tube substantially equally from all directions and achieves a smooth air flow through the annular channel 26. A small amount of air is metered through the openings 31 and flows through the inner air zone 22 out through the open distal end of the tube 23. The openings 31 are chosen to have a size relative to the size of the annular channel 26 so that 80 to 90 percent of the total air to the combustion zone flows in the annular channel 26 and so that the air flowing in the annular channel will be flowing at a significantly higher velocity than the air flowing out of the distal end of the tube 23. The size of the distal opening the in the tube 23 is selected to be 50–60 percent of the distal opening of the tube 23 and the tube 25 combined. The velocity of the air flow from the annular channel 26 will be 6–9 times the velocity of the air flowing through the inner zone out of the distal end of the tube 23. As a result of this difference in velocity, an axially recirculating flow pattern will be created in the combustion zone as indicated by the arrows 55. The axially recirculating flow pattern has no angular components because the air flow through both the outer air zone annular channel defined between the tube 25 and the wall of the tube 23 as well as the air flow in the inner air zone within the tube 23, is axial with no angular components. The feature of axial recirculation is instrumental in achieving burner flame stability and low NOx emission. Twirling of the air from the annular channel or from the inner air zone or any structure which would create an angular momentum to the air flow will increase the temperature in the combustion zone and increase the NOx emissions. Accordingly, the burner achieves low NOx burning by the combination of the axial recirculation in the combustion with no angular flow in the combustion zone.

The velocity air flow through the annular channel 26 has to be substantially greater than the velocity of air flow in the inner air zone in order to achieve the axially recirculating zone. On the other hand, this axially recirculating zone needs to be created with a minimum amount of turbulence which could be generated by shear between the two air streams entering the combustion zone with different velocities. Thus, the difference in the velocities must be maintained low enough to minimize shear caused turbulence at the boundary between the two air streams, which turbulence would increase the temperature in the combustion zone and, accordingly, would increase the NOx emissions.

U.S. Pat. No. 4,443,182 to Wojcieson et al. discloses a burner which does not have an objective of minimizing NOx emission. Instead, the burner of the patent is designed to be a high efficiency high temperature burner. In operation, this burner is described as generating axially recirculating flow patterns in the combustion zone. The patent describes a high velocity air flowing through an outer zone and that the high velocity air is above a critical velocity so as to create seed vortexes which are rapidly amplified to form large downstream expanding angularly rotating vortexes. These vortexes are highly turbulent angular flow which the applicant's invention seeks to avoid. Accordingly, the velocity of the flow through the outer zone in the burner of the present invention is kept below the critical velocity referred to in the Wojcieson et al. patent. As a result, in the combustion zone of the burner of the invention, there are no expanding angularly rotating vortexes and turbulence is minimized. As a result, the combustion temperature is maintained relatively low to achieve low NOx burning.

As described above, the burner of the present invention has both an oil nozzle and gas canes for supplying both kinds of fuel to the combustion zone. The burner may be operated with both fuels simultaneously or with either fuel alone. The burner provides combustion with low NOx emissions in all three modes of operation. In addition, the burner can be modified to be solely an oil burner or solely a gas burner by eliminating the corresponding fuel delivery component from the burner structure. These and other modifications may be made to the above described burner system without departing from the spirit and scope of the invention, which is defined in the appended claims.

I claim:

1. A low NOx burner comprising means defining a combustion zone, means to distribute fuel in fluid form into said combustion zone to be burned in said combustion zone, a central tube having an open end at said combustion zone, means defining an annular channel around said central tube, and having an open end at said combustion zone, means to cause air to flow axially through said central tube and through said annular channel with no angular flow component and with the velocity of flow in said annular channel being substantially greater than the velocity of flow in said central tube to generate axial recirculation in said combustion zone with no angular flow component, said central tube containing no obstructions affecting axial flow through said central tube and causing turbulence in said combustion zone, said annular channel containing no obstruction affecting axial flow through said annular channel and causing turbulence in said combustion zone.

2. A low NOx burner as recited in claim 1, wherein said means to distribute fuel to said combustion zone comprises a fuel oil nozzle and means to supply fuel oil under pressure to said nozzle, said nozzle comprising means to spray said fuel oil into said combustion zone at an angle relative to the axis of said central tube distributed concentrically with respect to said axis.

3. A low NOx burner as recited in claim 2, wherein said angle is between 30 and 45 degrees.

4. A low NOx burner comprising means defining a combustion zone, means to distribute fuel in fluid form into said combustion zone to be burned in said combustion zone, a central tube having an open end at said combustion zone, means defining an annular channel around said central tube, and having an open ed at said combustion zone, means to cause air to flow axially through said central tube and through said annular channel with no angular flow component and with the velocity of flow in said annular channel being substantially greater than the velocity of flow in said central tube to generate axial recirculation in said combustion zone with no angular flow component, wherein said means to distribute fuel to said combustion zone comprises means to distribute fuel gas to said combustion zone from a circular locus surrounding the axis of said tube from within said central tube and arranged to direct said gas outwardly at an angle.

5. A low NOx burner as recited in claim 4, wherein said angle is between 15–30 degrees with respect to the axis of said burner.

6. A low NOx burner as recited in claim 4, wherein said means to distribute fuel to said combustion zone further comprises a fuel oil nozzle and means to supply fuel oil under pressure to said nozzle, said nozzle comprising means to spray said fuel oil into said combustion zone at an angle relative to the axis of said central tube distributed concentrically with respect to said axis.

7. A low NOx burner as recited in claim 1, wherein said annular channel has an open proximal end and wherein said means to cause air to flow axially through said central tube and said annular channel comprises a windbox surrounding said tube and the proximal end of said annular channel and further comprises openings defined in said central tube to meter air flow from said windbox into said central tube, said windbox comprising means to provide uniform pressure distribution around the proximal end of said annular channel.

8. A low NOx burner as recited in claim 7, wherein said annular channel is defined between said central tube and an outer tube surrounding said central tube and coaxial therewith, said outer tube having an outwardly flared proximal end to receive air flow from said windbox.

9. A low NOx burner as recited in claim 7, wherein radial vanes are mounted in said annular channel to promote axial flow in said channel.

10. A low NOx burner as recited in claim 9, wherein said vanes divide said annular channel into arcuate segments and wherein said means to cause air to flow through said arcuate segments causes the air to flow with equal velocity through each of said arcuate segments.

11. A low NOx burner as recited in claim 1, wherein the area of the open end of said central tube is 50–60 percent of the area of the open end of said annular channel and said central tube combined and wherein said means to cause air flow causes 10–20 percent of the total air flow to said combustion zone to flow through said central tube.

12. A method of burning fuel in a low NOx burner, wherein said burner comprises a central tube and an annular channel surrounding said central tube, said central tube and said annular channel having open discharge ends opening to a combustion zone, comprising the steps of causing air to flow through said central tube and through said annular channel through said open discharge ends into said combustion zone in parallel axial streams with no radial or angular components within said central tube and said annular channel adjacent to said combustion zone with the relative velocity of the stream flowing through said annular channel being sufficiently greater than the stream flowing through said central tube to cause axial recirculation in said combustion zone, and burning fuel in said combustion zone where said axial recirculation occurs.

* * * * *

UNITED STATES PATENT AND TRADEMARK OFFICE

CERTIFICATE OF CORRECTION

PATENT NO. : 5,299,930

DATED : April 5, 1994

INVENTOR(S) : George Weidman

It is certified that error appears in the above-indentified patent and that said Letters Patent is hereby corrected as shown below:

Column 5, claim 4, line 24, "ed" should be --end--.

Signed and Sealed this

Eighth Day of November, 1994

*Attest:*

*Attesting Officer*

BRUCE LEHMAN

*Commissioner of Patents and Trademarks*